United States Patent [19]

Cassou et al.

[11] Patent Number: 4,654,025

[45] Date of Patent: Mar. 31, 1987

[54] ARTIFICIAL INSEMINATION APPARATUS

[76] Inventors: Robert Cassou; Maurice Cassou, both of Rue Clémenceau; Bertrand Cassou, Saint Symphorien des Bruyeres, all of 61300 L'Aigle, France

[21] Appl. No.: 726,514

[22] Filed: Apr. 24, 1985

[30] Foreign Application Priority Data

May 4, 1984 [FR] France ..... 84 06963

[51] Int. Cl.[4] ..... A61D 7/02

[52] U.S. Cl. ..... 604/55; 604/96; 604/101; 604/187; 604/218; 604/DIG. 1

[58] Field of Search ..... 604/55, 96, 101, 103, 604/97, 181, 187, 218, 54, 263, 275, DIG. 1

[56] References Cited

U.S. PATENT DOCUMENTS

| | | | |
|---|---|---|---|
| 3,256,884 | 6/1966 | Hill et al. | 604/DIG. 1 |
| 3,707,146 | 12/1972 | Cook et al. | 604/96 X |
| 3,910,275 | 10/1975 | Babey et al. | 604/DIG. 1 |
| 4,089,337 | 5/1978 | Kronner | 604/96 |
| 4,173,227 | 11/1979 | Cassou et al. | 604/275 |

FOREIGN PATENT DOCUMENTS

| | | | |
|---|---|---|---|
| 2286659 | 4/1976 | France | 604/93 |
| 2477005 | 2/1980 | France | 604/97 |

*Primary Examiner*—Stephen C. Pellegrino
*Assistant Examiner*—John D. Ferros
*Attorney, Agent, or Firm*—Bachman & LaPointe

[57] ABSTRACT

The invention relates to apparatus for artificial insemination of animals, and particularly carnivores such as dogs, foxes, wolves and even smaller animals such as mink.

The apparatus comprises a flexible probe having apertures at each end, in which is mounted slidingly a semen reservoir tube, which is also flexible, a projecting end of the semen tube presenting a head and an orifice behind said head through which the semen is ejected from the tube, the other end of the semen tube being coupled with a sheath having a removable abutment limiting the stroke of the sheath and tube in the probe, a piston extending through the sheath to engage in the tube for actuation to eject semen therefrom, and balloons extending externally round the probe for inflation once the probe is disposed in the vaginal cavity of the animal by compressed air blown through a separate conduit in the probe from that receiving the semen tube.

9 Claims, 3 Drawing Figures

ARTIFICIAL INSEMINATION APPARATUS

BACKGROUND OF THE INVENTION

The invention relates to non-surgical artificial insemination apparatus for various animals and particularly, but not exclusively, for carnivores such as dogs, foxes, wolves and even smaller sized animals such as mink, for example.

Natural insemination of carnivores is vaginal. During coitus, the turgescent erectile bulbs lock the penis in the vagina and ejaculation occurs into the region in front; the partners may stay coupled for more than ten minutes, so that this physiological adaptation avoids the sperm flowing back out under gravity, which would otherwise be likely to occur, due to the anatomy of the genital organs of these animals.

DESCRIPTION OF THE PRIOR ART

Unlike the larger species, such as cows and horses particularly, it is not indispensable for carnivores to deposit the semen directly into the uterus. Natural insemination is vaginal, as indicated above, and in any case this operation would be very difficult to achieve and likely to be traumatic for the animal. Current techniques, using rigid probes, use massive quantities of sperm, and require a very uncomfortable retention during several minutes to avoid the sperm flowing back out.

Thus the technical difficulties due especially to the morphology of the genital organs of carnivore animals prevent use of current techniques, especially the technique of inseminating small quantities of frozen sperm from selected males.

The artificial insemination apparatus according to the present invention has been designed to take account of the physiological, technical and zoological objectives in order to be used in the reproduction of carnivore and other animals, especially those having a descending vaginal cavity from which the sperm is likely to flow back out.

OBJECTS OF THE INVENTION

An object of the invention is to provide the union and interacting combination of various means and components, some of which may already be employed for collecting or transplanting embryos, these features never having previously been united for artificial insemination, especially not for insemination of carnivores, for which a specific apparatus is required.

One specific object of the invention is to provide an apparatus comprising an injection probe which is flexible, and which therefore will avoid traumatising the animal, and a device (whose design may be known per se) which reproduces the conditions of natural coitus by enabling the sperm to be placed in the anterior region of the vagina while avoiding the sperm flowing back out by an inflatable balloon system imitating the erection of the male's penis.

Another object of the invention is to avoid contamination of the sperm while the probe is being introduced into the vaginal cavity until the probe has reached a position adjacent to the uterine orifice after passing through the vagina. To this end, the semen expulsion orifice is masked during the introduction of the probe so as to avoid contact between the sperm, and impurities such as cervical mucus.

Another object of the invention is to provide a probe which is flexible but which may readily be handled so as to pass round the mucous folds of the vagina without traumatisation, so that the probe can be brought into maximum contact with the endometrium.

Yet further objects of the invention are to provide an apparatus which is also usable in simplified form for insemination of small-sized animals such as mink, and an apparatus which can be used for immediate insemination (without storage of the semen) when both male and female reproducers are present.

BRIEF DESCRIPTION OF THE INVENTION

The present invention provides artificial insemination apparatus comprising an elongate probe member presenting first and second apertures at respective first and second ends, a semen tube for mounting slidingly within said probe member, said semen tube containing semen and presenting a head at one end for projecting through said first aperture and an orifice also at said one end through which said semen may be expelled, a sheath member for coupling with said semen tube and for mounting slidingly with said semen tube in said second end of said probe member, abutment means cooperating with said sheath member and said probe for limiting the sliding movement of said sheath member through said probe member towards said first end, a piston for passing through said sheath from said second aperture to engage in said semen tube, said piston being actuable to urge semen through said orifice whereby to eject semen through said first aperture, and inflatable means extending externally round said probe member, said probe member presenting conduit means sealed from said semen tube and said orifice and communicating with said second end of said probe member and with said inflatable means, whereby said probe member may be inserted into the vaginal cavity of the animal with said inflatable means deflated, and said inflatable means then inflated by fluid introduced therein through said conduit from said second end of said probe member, the assembly of said probe member and said semen tube being flexible, whereby to enable said assembly to adapt to the shape of the vaginal cavity.

The manufacture of a preferred embodiment of the invention is made simpler in that said probe member comprises a single-piece extrusion presenting a longitudinal duct extending between said first and second apertures to receive said semen tube and said sheath member, said conduit extending longitudinally in the thickness of said probe member separately from said duct and communicating with said inflatable means through a radial orifice.

DESCRIPTION OF THE DRAWINGS

Other features and advantages of the invention will appear from the following description given by way of example with reference to the accompanying drawings, in which.

DESCRIPTION OF THE PREFERRED EMBODIMENTS OF THE INVENTION

Figure 1:
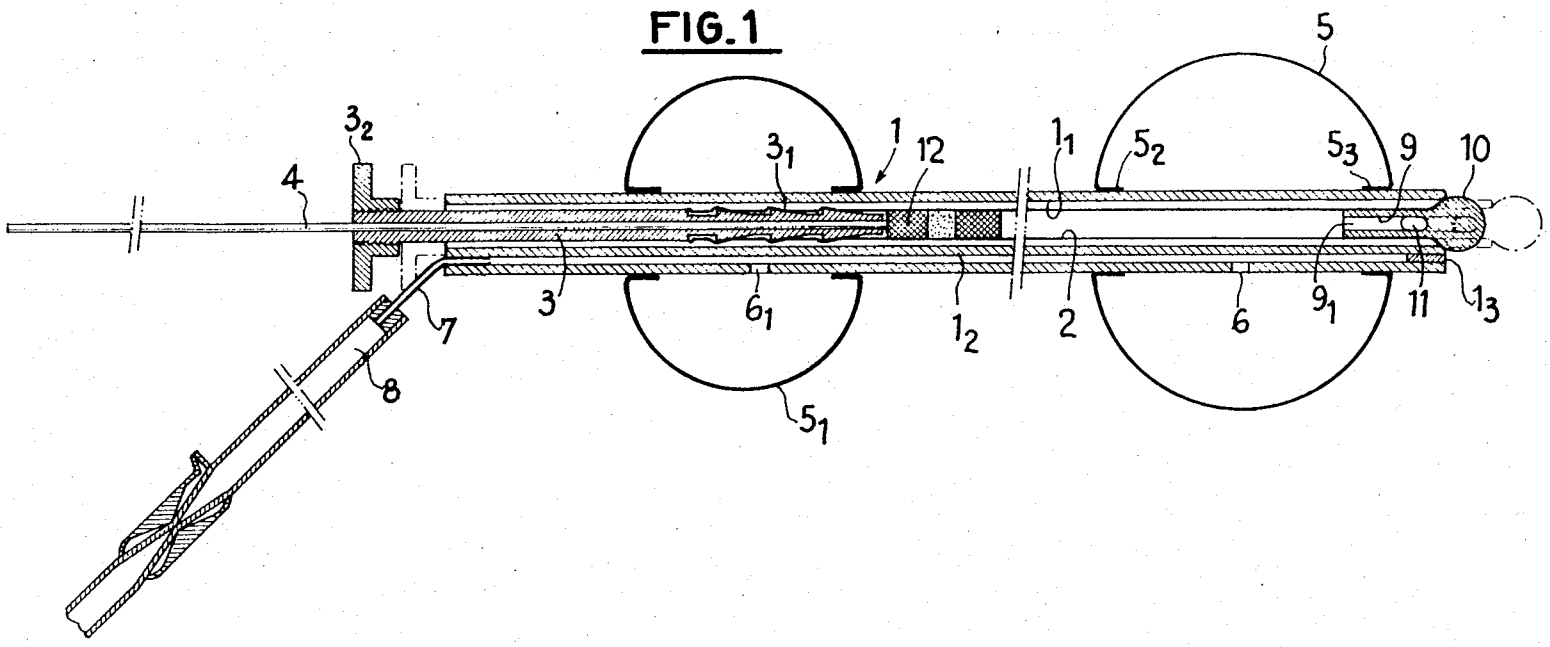
FIG. 1 is a longitudinal sectional view of an insemination apparatus in accordance with the invention.

As shown in FIG. 1, the artificial insemination apparatus comprises an injection probe 1 which receives a semen reservoir 2, coupled with a guide-sheath 3 within which moves a piston 4.

The injection probe 1 is in the form of a flexible sheath, in polyvinylchloride (P.V.C.) for example, that is to say comprising a material which is tough but sufficiently malleable to bend and follow the meanders of the vaginal cavity of the animal, and pass through the mucous folds of the vagina without wounding nor traumatising the genital apparatus. This sheath is open at each end and its tubular shape defines a longitudinal channel into which the semen reservoir is inserted. The reservoir 2 may, as preferred, be a tube in which the semen has been stored and conserved (according to a well-known cryogenic method) or a flexible duct with a spherical head connected directly to a semen stock from a male reproducer, the latter being particularly appropriate when both the male and female are present and the insemination is extemporaneous. In both cases, the reservoir tube or semen duct are made of a flexible material so as not to impair the malleable nature of the probe.

The probe is made in the form of a unitary part by extrusion, and comprises a main duct $1_1$ which accomodates the semen reservoir 2 and an auxiliary duct $1_2$ of reduced circular section, extending within the thickness of the probe, the auxiliary duct communicating with a balloon 5 or $5_1$ through at least one radial orifice $6$–$6_1$, the front end of the duct $1_2$ being blocked by a bung $1_3$, while its rear end is connected to the nozzle 7 of a compressed air syringe 8, whose function is to blow fluid into the balloons $5$–$5_1$, which are shown in the inflated condition in FIG. 1. The balloon 5 surrounds a front portion of the probe 1 and is fixed at its edges at $5_2$ and $5_3$. During the introduction phase, the balloons are obviously deflated and adopt practically the longitudinal shape of the probe.

In the embodiment shown in FIG. 1, the semen reservoir comprises a storage tube in the form of a tubular "paillette", whose front end presents a nozzle 9, whose end part is a spherical head 10. This nozzle comprises a blind bore $9_1$ communicating at its open end with the semen reservoir 2 and at its closed end with the exterior through at least one radial orifice 11 disposed behind the spherical head 10. The other end of the reservoir tube 2 is coupled with the sheath, which has the feature of presenting fixing claws $3_1$, which are forced into the rear end of the reservoir tube 2 so as to obtain a positive coupling. The guide-sheath is rigid so as to offer a good grip and facilitate handling of the probe, the whole of whose front part is flexible and deformable. The rear or back part of the guide-sheath receives a removable abutment $3_2$, for example a ring presenting a shoulder screwed onto a threaded end portion of the guide sheath. This ring will serve, as described below, to limit the stroke of the guide-sheath reservoir tube assembly in its movement inside the injection probe 1.

The piston 4 is mounted for movement within the tubular guide-sheath and serves to expel the semen through the intermediary of a plug 12 blocking the reservoir tube and movable therein.

The operation of this artificial insemination apparatus is very simple.

In the embodiment described above, the operation begins by taking a reservoir tube which already has its spherical headed nozzle, the semen being maintained therein by surface tension. The rear end of this reservoir tube being initially welded shut, this end is cut off and the guide-sheath 3 introduced therein after taking off the identification ring of the donor which is disposed in this rear part of the reservoir tube. When the tube and guide sheath are coupled together, the assembly is introduced into the injection probe 1 by its front end, the abutment $3_2$ having first been unscrewed. When the assembly is introduced, the piston 4 is engaged into the guide-sheath 3 and then the abutment $3_2$ is screwed onto the end of the guide-sheath.

In this condition, the apparatus is ready for use, since the piston 4 is in contact with the plug or core 12 of the semen reservoir, the ballons are collapsed and the compressed air syringe is turned off.

Figure 2A:
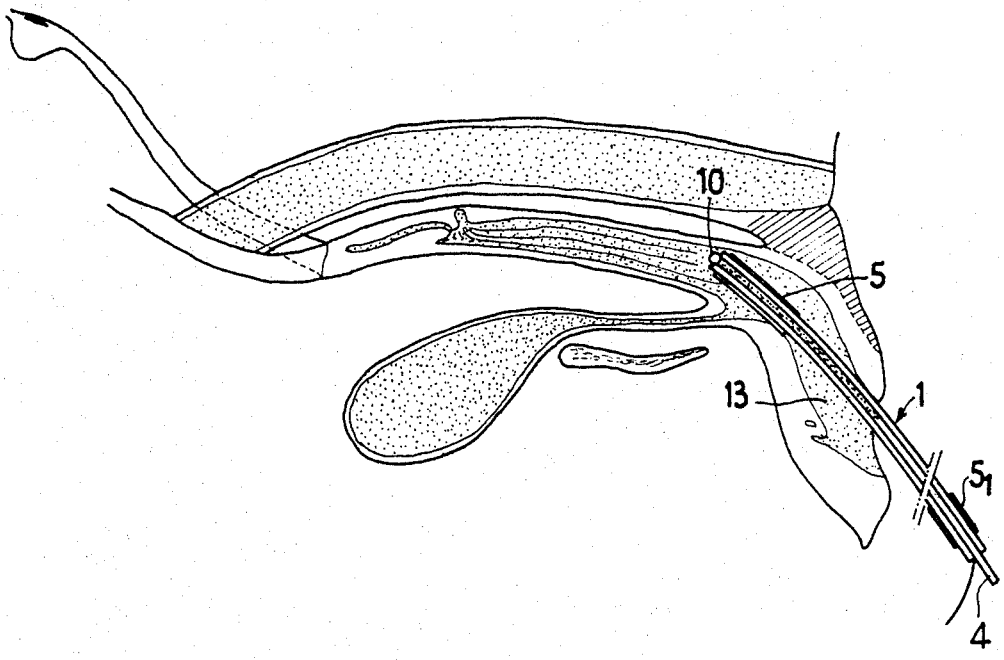
FIGS. 2A and 2B are longitudinal sectional views of the apparatus of FIG. 1 in use.

Next, as shown in FIG. 2A, the injection probe is introduced into the vaginal cavity 13 of the animal, and follows readily the meanders of the cavity and passes through the mucus folds. As shown in FIG. 2A, the balloons $5$–$5_1$ are deflated and adopt practically the tubular shape of the injection probe 1.

Figure 2B:
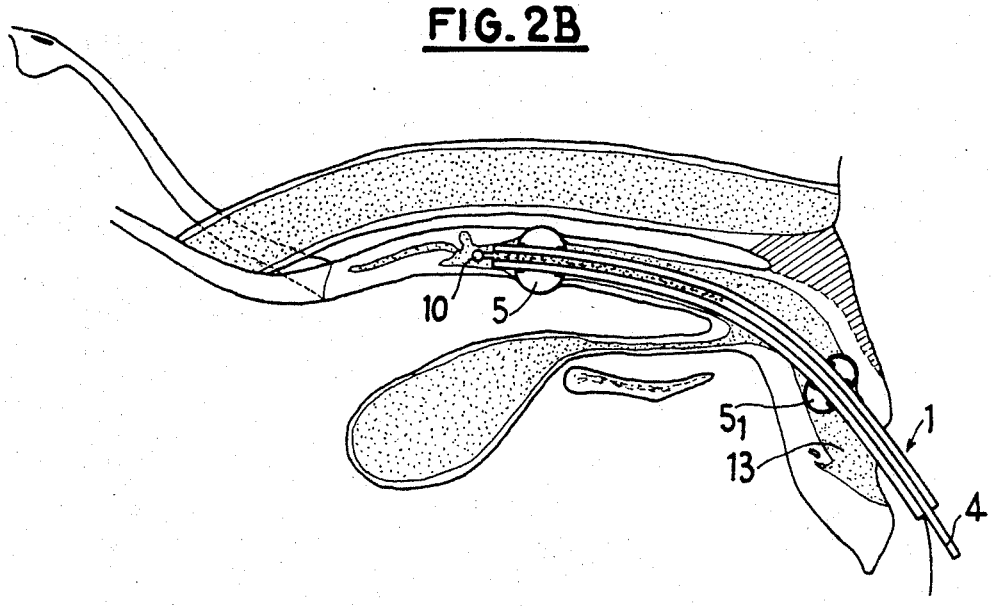

The introduction of the probe continues as shown in FIG. 2B, until the probe is juxtaposed with the uterine opening and is ready to inject the semen. During this passage, the semen has been shielded from impurities and in particular from the cervical mucus by the spherical head 10 of the reservoir tube 2 applied against the front end of the injection sheath 1 to mask the orifices 11 through which the semen will be expelled (as shown in FIGS. 1 and 2A). It will be seen from FIG. 1 that the spherical head 10 in this position (shown in full lines) obstructs the front orifice of the probe, the abutment $3_2$ being retracted.

When the probe has reached the injection position, the abutment $3_2$ is pushed forward so that the reservoir tube guide-sheath assembly slides forward and the spherical head projects out of the probe, uncovering the semen expulsion orifices 11 (position shown in chain-dotted lines in FIG. 1). Next, compressed air is blown into the auxiliary duct $1_2$ by means of the syringe 8 and expands into the balloons $5$–$5_1$ through the orifices $6$–$6_1$, so that the balloons swell and mate with the neck of the uterus, reproducing the condition of the erected penis during natural coitus. The inflation of the balloons not only achieves positive coupling of the probe, but also enables the spherical head 10 to be positioned correctly opposite the uterine opening and dilates the vaginal and uterine walls which prepares the orgasm of the female, favourable to acceptance and progression of the semen. Thus, the communication between the animal's body and the semen is only established once the apparatus is correctly introduced and positioned.

In the case of small-sized animals, such as mink, it is possible to reduce the diameter of the apparatus by eliminating the injection sheath and introducing directly into the vaginal cavity the assembly of the reservoir tube 2 and the guide sheath 3, this assembly having a substantially smaller diameter than that shown in FIG. 1 (more than 50% reduction). Thus the artificial insemination apparatus as described above is well adapted to the physiological conditions of carnivore animals since it takes account of their morphology and of their sexual aptitude, and also enables natural coitus to be reproduced almost exactly by means of the deformable probe which in its operational condition resembles an erect penis, the probe being flexible over most of its length so as to adapt to the path of the vaginal cavity without bruising it or traumatising it.

It has been observed by radiography that the passage of semen into the uterine opening is obtained in excellent conditions, this observation having been made using a liquid which is opaque to X-rays in order to simulate the movement of the sperms. A necroscopic examination has also been made using an opaque oily liquid which was inseminated into a bitch to which an accident had occured while the bitch was on heat, producing an irreversible deep coma, the autopsy revealing that the liquid was properly disposed in the uterus a quarter of an hour after the insemination.

The above observations demonstrate that it is possible to inseminate all animals, even those reputed to be dangerous, using a general anaesthetic if necessary. The apparatus described may indeed be made of a size suitable for other carnivorous or herbivorous species, which offers a large number of usages, bearing in mind the protection and development of animals in danger of extinction.

The apparatus is single-use (only the metallic guide-sheath can be re-used). The apparatus is extracted ten to fifteen minutes after the expulsion of the semen by deflating the balloons and pulling the probe out.

The apparatus in accordance with the invention enables the installation and development of artificial insemination of carnivores, particularly by deep-frozen sperm, and consequently the development of furred animals such as dogs, foxes, wolves, mink and other species of similar type.

What is claimed is:

1. An artificial insemination apparatus for a female animal comprising: an elongate probe member having a main duct and first and second apertures at respective first and second ends suitable for sliding into the vaginal cavity of the animal, with the first end introduced first; a semen tube having a first and second end and mounted slidingly within the main duct, said semen tube containing semen, being provided with a head at said first end and having a radial orifice at said first end through which said semen may be expelled, said head projecting through the first aperture of the probe member; a sheath member coupled to said semen tube and mounted slidingly within the main duct together with said semen tube and penetrating into said probe member through said second aperture; abutment means mounted within the main duct cooperating with said sheath member and said probe member for limiting the sliding movement of said sheath member within said probe member towards said first end; a piston passign through said sheath and then also penetrating into said probe member through said second aperture to engage said semen tube, said piston being actuable to urge semen towards said first aperture whereby to eject semen through said orifice; inflatable means extending externally around said probe member; conduit means extending along said probe member and separated from said main duct sealed at said first end of the probe member and open at said second end of said probe member; a nozzle received in the open end of the conduit means; a compressed fluid syringe communicating with said nozzle and said inflatable means, whereby said probe member may be inserted into the vaginal cavity of the animal with said inflatable means deflated and then said inflatable means may be inflated by fluid introduced therein through said conduit means from said second end of said probe member, wherein the assembly of said probe member and said semen tube inserted therein being flexible, to enable said assembly to adapt to the shape of the vaginal cavity of said female animal.

2. Apparatus as claimed in claim 1, wherein said probe member comprises a single-piece extrusion presenting a longitudinal duct extending between said first and second apertures to receive said semen tube and said sheath member, said conduit extending longitudinally in the thickness of said probe member separately from said duct and communicating with said inflatable means through a radial orifice.

3. Apparatus as claimed in claim 2 and including compressed air means for connection to said conduit whereby to inflate said inflatable means with compressed air.

4. Apparatus as claimed in claim 2, wherein said orifice of said semen tube is disposed behind said head, the assembly of said sheath member and said semen tube being displaceable between a first position in which said head blocks said first aperture and masks said orifice of said tube from ingress of impurities during insertion of said probe into the vaginal cavity, and a second position in which said head projects from said first aperture to uncover said orifice for expulsion of said semen therethrough.

5. Apparatus as claimed in claim 1, wherein said orifice of said semen tube is disposed behind said head, the assembly of said sheath member and said semen tube being displaceable between a first position in which said head blocks said first aperture and masks said orifice of said tube from ingress of impurities during insertion of said probe into the vaginal cavity, and a second position in which said head projects from said first aperture to uncover said orifice for expulsion of said semen therethrough.

6. Apparatus as claimed in claim 1, wherein said sheath member is rigid and comprises projections for engaging said semen tube, whereby to couple said sheath member and semen tube together.

7. Apparatus as claimed in claim 1, wherein said inflatable means comprises first and second inflatable parts disposed adjacent said first and second ends of said probe member, said first and second parts being simultaneously inflatable.

8. A method of inseminating a female animal comprising: providing an apparatus comprising an elongate probe member having a main duct and first and second apertures at respective first and second ends suitable for sliding into the vaginal cavity of the animal, with the first end introduced first, a semen tube having a first and second end and mounted slidingly within the main duct, said semen tube containing semen, being provided with a head at said first end and having a radial orifice at said first end through which said semen may be expelled, said head projecting through the first aperture of the probe member, a sheath member coupled to said semen tube and mounted slidingly within the main duct together with said semen tube and penetrating into said probe member through said second aperture, abutment means mounted within the main duct cooperating with said sheath member and said probe member for limiting the sliding mvoement of said sheath member within said probe member towards said first end, a piston passing througn said sheath and then also penetrating into said probe member through said second aperture to engage said semen tube, said piston being actuable to urge semen towards said first aperture whereby to eject semen through said orifice, inflatable means extending externally around said probe member, conduit means extending along said probe member and separated from said main duct sealed at said first end of the probe member and open at said second end of said probe member, a nozzle received in the open end of the conduit means and a compressed fluid syringe communicating with said nozzle and said inflatable means; inserting said apparatus in the vaginal cavity of the animal with said inflatable means deflated until said first end is adjacent the uterine orifice of the animal; inflating said inflatable means whereby to block the vaginal cavity and actuating said piston from said second end to eject semen from said tube through said first aperture into the uterus.

9. A method as claimed in claim 1, wherein the animal is a small animal and the apparatus is inserted without said probe member.

* * * * *